US006473050B2

(12) United States Patent
Foncin

(10) Patent No.: US 6,473,050 B2
(45) Date of Patent: Oct. 29, 2002

(54) MOTOR-DRIVE DEVICE FOR SENSORS IN A RECEIVER AND/OR TRANSMITTER WITH SPHERICAL ELECTROMAGNETIC LENS AND RECEIVER AND/OR TRANSMITTER COMPRISING SUCH A DEVICE

(75) Inventor: Pierre Foncin, Les Clayes S/S Bois (FR)

(73) Assignee: Thomson-CSF, Paris (FR)

( * ) Notice: Subject to any disclaimer, the term of this patent is extended or adjusted under 35 U.S.C. 154(b) by 0 days.

(21) Appl. No.: 09/820,847

(22) Filed: Mar. 30, 2001

(65) Prior Publication Data

US 2002/0024477 A1 Feb. 28, 2002

(30) Foreign Application Priority Data

Mar. 31, 2000 (FR) ..... 00 04139

(51) Int. Cl.[7] ..... H01Q 3/12; H01Q 15/08

(52) U.S. Cl. ..... 343/754; 343/911 L

(58) Field of Search ..... 343/753, 754, 343/757, 911 L; H01Q 19/06, 3/12, 15/08

(56) References Cited

U.S. PATENT DOCUMENTS 4,531,129 A 7/1985 Bonebright et al. ..... 343/754

5,365,296 A * 11/1994 Murakami et al. ..... 354/195.1

FOREIGN PATENT DOCUMENTS

| | | |
|---|---|---|
| FR | 2 762 935 | 11/1998 |
| FR | 2 770 343 | 4/1999 |

OTHER PUBLICATIONS

Patent Abstract of Japan, vol. 17, No. 328, Jun. 22, 1993 and JP 5–037221 A, Feb. 12, 1993.

Patent Abstract of Japan, vol. 17, No. 661, Dec. 7, 1993 and JP 5–218721 A, Aug. 27, 1993.

Patent Abstract of Japan, vol. 18, No. 13, Jan. 11, 1994 and JP 5–254499 A, Oct. 5, 1993.

* cited by examiner

*Primary Examiner*—Michael C. Wimer
(74) *Attorney, Agent, or Firm*—Oblon, Spivak, McClelland, Maier & Neustadt, P.C.

(57) ABSTRACT

A motor-drive device for sensors around a spherical electromagnetic lens, for example a Luneberg type lens using in a system of transmission and/or reception, comprises, for each module, at least one piezoelectric motor rigidly connected to the module, the module moving in the vicinity of the surface of the lens by the reptation of the piezoelectric motor on this surface. The disclosed device can be applied especially to receivers and/or transmitters carrying out multiple-satellite tracking, for example in the field of communications by orbiting satellites.

29 Claims, 5 Drawing Sheets

MOTOR-DRIVE DEVICE FOR SENSORS IN A RECEIVER AND/OR TRANSMITTER WITH SPHERICAL ELECTROMAGNETIC LENS AND RECEIVER AND/OR TRANSMITTER COMPRISING SUCH A DEVICE

BACKGROUND OF THE INVENTION

1. Field of the Invention

The present invention relates to a motor-drive device for sensors around a spherical electromagnetic lens, for example a Luneberg type lens using in a system of transmission and/or reception. The invention can be applied especially to receivers and/or transmitters carrying out multiple-satellite tracking, for example in the field of communications by orbiting satellites.

Satellite communications have become very important. In addition to the commonly used geostationary satellites, there are orbiting satellites, especially for wide-band, high-bit-rate telecommunications, for example for multimedia applications.

2. Description of the Prior Art

It is thus necessary to provide for ground stations that can track several satellites at the same time. The basic techniques to be used are known. A station generally includes a wide frequency band omnidirectional transmission and/or reception device. There are known ways of making a device of this kind by using an electromagnetic spherical lens, for example of the Luneberg type, associated with mobile microwave sensors in the immediate vicinity of the lens surface. Through an appropriate disposition of the index gradient of the constituent material of the lens, it is possible that a microwave parallel beam striking the upper face of the lens, oriented skywards, will converge by incurvated rays towards the point diametrically opposite the point at which the normal to this beam is tangential to the sphere. A microwave sensor held in the vicinity of this diametrically opposite point picks up the wave of this beam coming, for example, from a satellite.

As a rule, a transmission and/or reception device designed for multiple-satellite tracking must follow at least two orbital satellites at the same time. These satellites are redundant, namely they provide the same information traffic. When, as a result of the orbiting, one of the satellites being tracked goes out of sight, for example by vanishing over the horizon, the transmission and/or reception device switches over to the other satellite. The transmission and/or reception device thus has at least two microwave sensors as well as means to control the position of the sensors as a function of the information available on the position of the satellites to be targeted.

Since the sensors have to move in the vicinity of the entire inner surface of the spherical lens, it is useful to provide for a suitable motor-drive mechanism. Known mechanisms make use of systems of circular rails rotating around the lower half sphere. The sensors move on these circular rails. These mechanisms require several electrical motors. They require at least one motor to make the rail rotate, and one motor per sensor. The result is a complex and costly mechanism. The high cost arises especially from the cost of the electrical motors. The complexity of the system as well as the relative reliability of the motors lowers the overall reliability of the motor-drive assembly.

It can be seen therefore that prior art motor-drive systems for sensors in a receiver and/or transmitter with spherical lens have at least two drawbacks, firstly high cost and secondly, lack of reliability. These two drawbacks are especially very troublesome for multimedia applications, namely large-scale consumer applications. In applications of this type, a receiver and/or transmitter is placed for example on the roof of a dwelling, and it is not desirable to have to make frequent emergency repairs to a motor-drive system. The reliability of this system is therefore very important and, obviously, so is the competitive cost of this receiver and/or transmitter as a whole.

SUMMARY OF THE INVENTION

It is an aim of the invention to overcome the above-mentioned drawbacks. To this end, an object of the invention is a motor-drive device for transmission and/or reception modules in a receiver and/or transmitter with spherical electromagnetic lens, this device comprising, for each module, at least one piezoelectric motor rigidly connected to the module. The module moves in the vicinity of the surface of the lens by the reptation of the piezoelectric motor on this surface.

An object of the invention is also a receiver and/or transmitter with spherical electromagnetic lens using a device of this kind.

The main advantages of this invention are that it brings a reduction in the weight of transmission and/or reception device with Luneberg lens and improves the electrical and microwave performance characteristics of such a device.

BRIEF DESCRIPTION OF THE DRAWINGS

Other features and advantages of the invention shall appear from the following description made with reference to the appended drawings, of which.

MORE DETAILED DESCRIPTION

Figure 1:
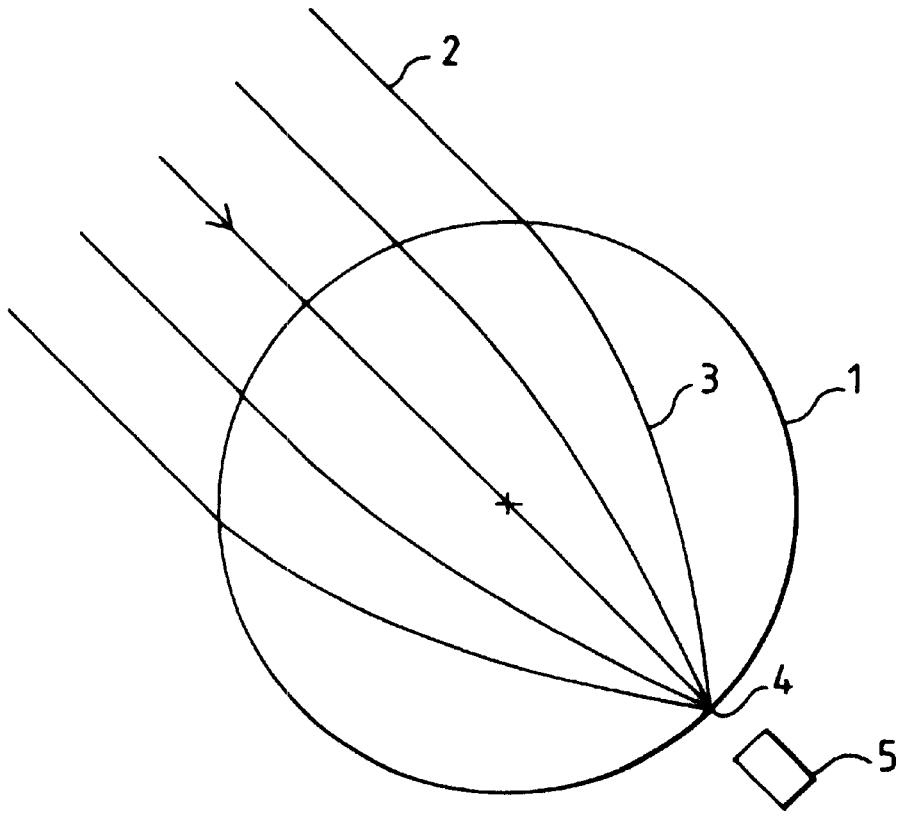
FIG. 1 illustrates the principle of operation of a transmission and/or reception device using a spherical electromagnetic lens, for example of the Luneberg type.

FIG. 1 illustrates the principle of operation of a transmission and/or reception device using a spherical electromagnetic lens 1, for example a lens known as a Luneberg lens. Using an appropriate disposition of the index gradient of the constituent material of the lens, it may be seen that a parallel beam 2 striking the upper face of the lens, oriented skywards, will converge by incurvated rays 3 towards the point 4 which is diametrically opposite the point at which the normal to this beam is tangential to the sphere. A microwave transmission and reception mop 5, hereinafter called a sensor, held in the vicinity of this point 4, may therefore pick up the radiation carried by the beam 2, coming for example from a satellite. To track at least two orbiting satellites, it is necessary to have at least two sensors capable of moving in the vicinity of the surface of the lens. A lens support mechanism to move these sensors facing the entire lower face of the lens should therefore be provided.

Figure 2:
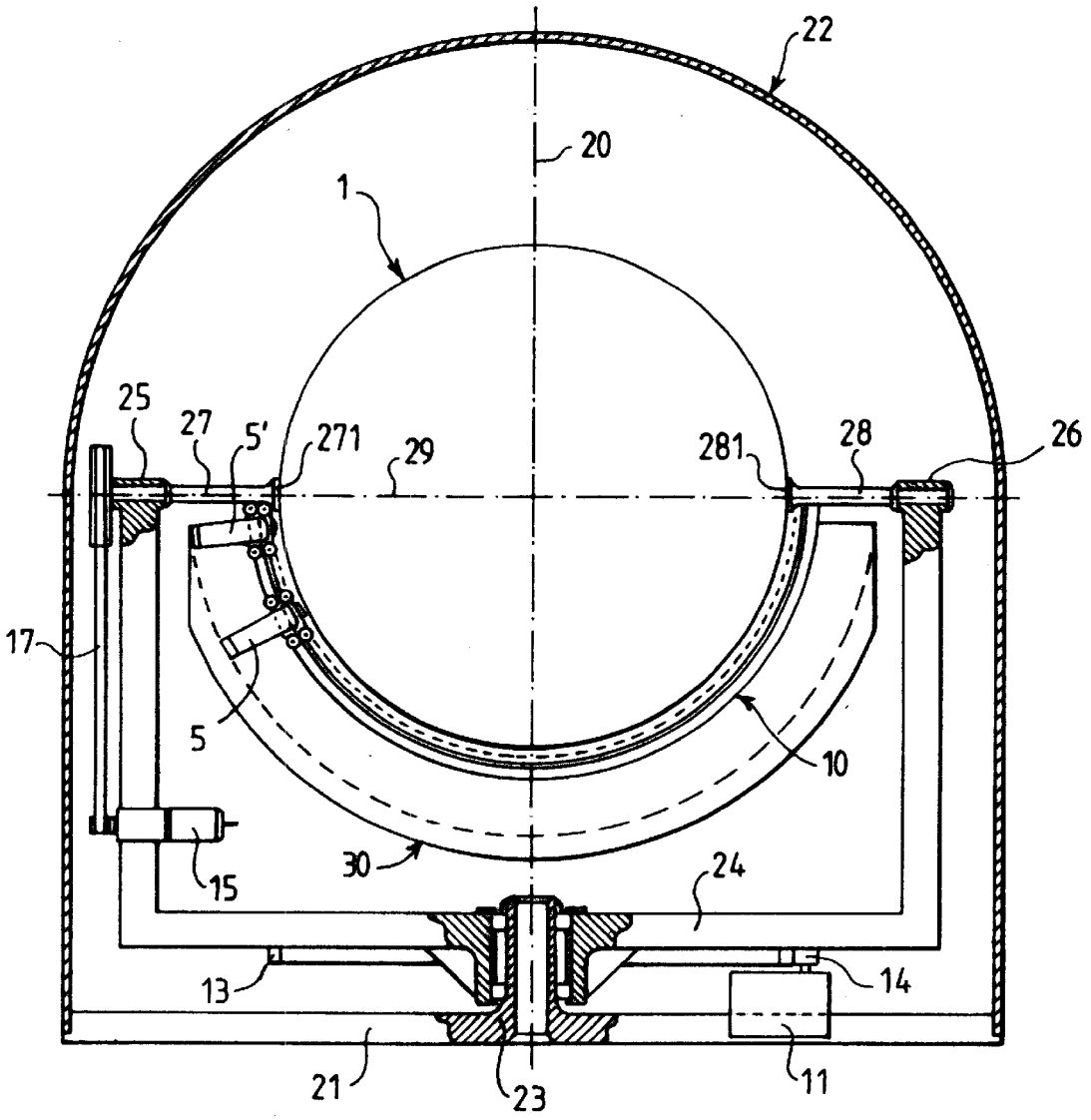
FIG. 2 exemplifies a motor-drive system for sensors according to the prior art in transmission and/or reception device with spherical electromagnetic lens.

FIG. 2 shows an exemplary motor drive mechanism for the sensors according to the prior art. The transmission and/or reception device has a spherical electromagnetic lens 1 located inside a radome 22 supported for example on a stand 21. The spherical lens 1 has support means so that it can leave a vacant space for the movement of the sensors 5, 5' along the lower surface. FIG. 1 shows one example of support means among other possibilities. These means lie on the stand. Thus, for example, the stand 21 bears at its center a shaft 23 supporting a generally U-shaped frame 24. The ends of the arms of the U support bearings 25, 26. These bearings support two half-shafts 27, 28 that are mechanically fixed to the spherical lens 1, along one of its big diameters preferably located in the horizontal plane. Each half-shaft 27, 28 is fixedly joined to the lens by means of a metal part 271, 281 bonded to the lens. The metal part may be an integral part of the half-shaft.

The motor drive for the sensors 5, 5' is obtained by means of a metal part 30, shaped like the arc of a circle, hereinafter called an arc-shaped part 30. This arc-shaped part 30 is mobile around the lower surface of the lens, the two sensors being mobile on this part 30, for example by means of a rail 10 carried by the part. The motion of the arc-shaped part 30 around the lens is given by two motors 11, 15. Since this part 30 is held by the two half-shafts 27, 28, it is driven in a first rotational motion by a first motor 27. This first rotational motion is made around the vertical axis 20 of the lens. To this end, the lower part of the frame 24 is provided, for example, with a toothed ring 13 that works together with the roller 14 of the motor 27. The arc-shaped part 30 is driven in a second rotational motion by the second motor 15. This second rotational motion is partial around a horizontal axis 29 of the lens 1. The part 30 remains facing the lower half-sphere of the lens. This rotational motion is transmitted to the part 30 by means of a belt 17 driving the half-shafts 27, 28 rotationally. Through these two rotational motions of the arc-shaped part 30, it is possible to track two satellites at the same time. In other words, it is always possible to find a diametrical plane on the spherical electromagnetic lens that passes through the two lines of sight of the sensors 5, 5' by placing the part 30 in this diametrical plane by means of the two motors 11, 15. Two additional motors (not shown), however, are still important to make fine adjustments of the position of the two sensors on the rail of the part 30.

An embodiment according to FIG. 2 should therefore comprise at least four electrical motors. This set of motors and associated mechanisms, such as reduction gear or other mechanical coupling elements, entails high costs and lower reliability for the motor-drive system for the sensors and therefore for the transmission and/or reception device.

Figure 3:
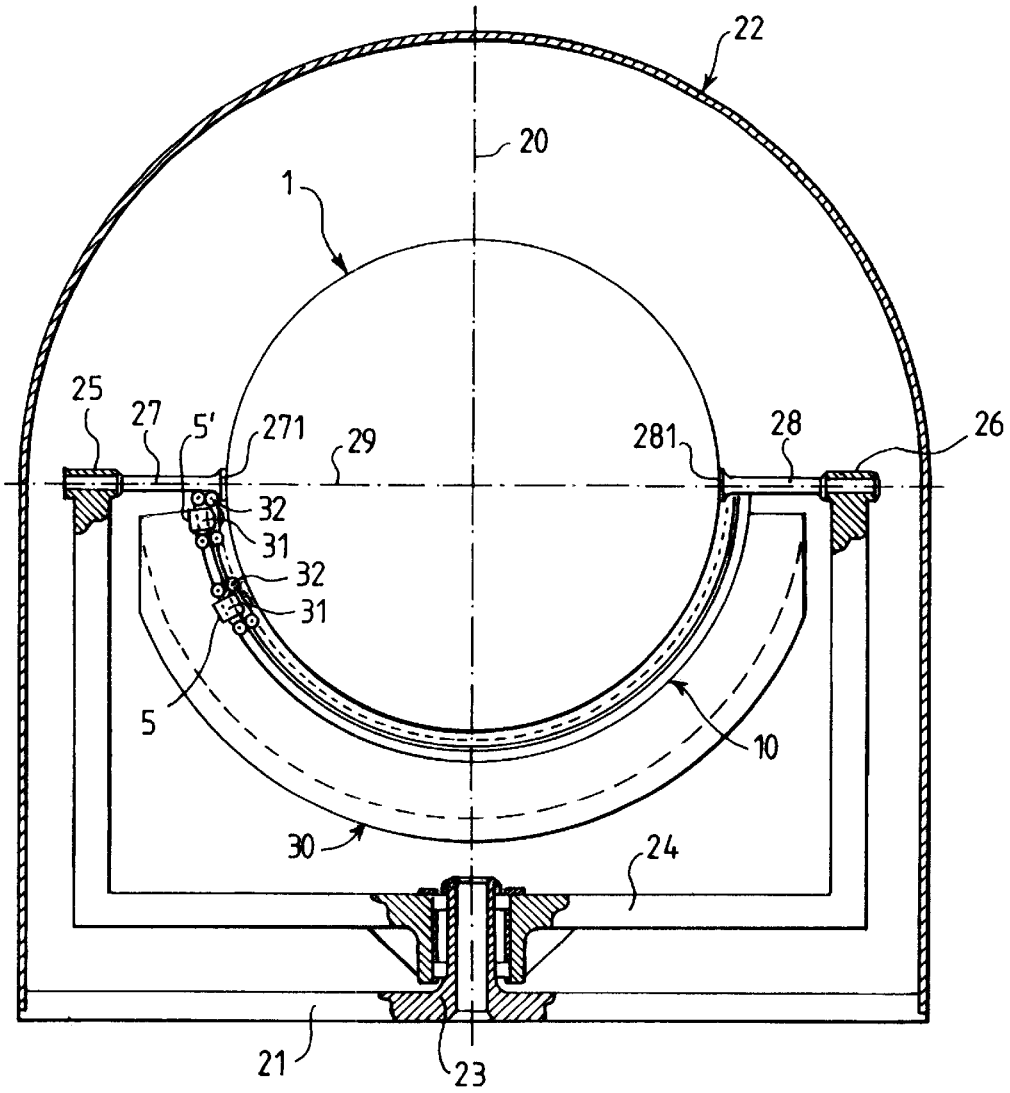
FIG. 3 exemplifies a motor-drive system for sensors according to the invention.

FIG. 3 illustrates an exemplary embodiment of a motor drive system for sensors according to the invention. The movement of each sensor on the surface of the spherical electromagnetic lens is provided by friction by means of a resonating piezoelectric motor. More particularly, since a sensor is rigidly connected to a piezoelectric motor, the movement of the sensor in the vicinity of the surface of the lens is provided by the reptation of the motor on this surface. In particular, two piezoelectric motors will therefore replace the four motors and their associated mechanisms to motorize the two sensors. The result thereof is a reduction in complexity and cost.

In this embodiment, the supporting system for the arc-shaped part 30, comprising especially the U-shaped part 24 and the half-shaft 27, 28, are not motor driven. The part 24 freely rotates with respect to the shaft 23. Similarly, the half-shafts 27, 28 freely rotate with respect to the U-shaped part 24. The part 30 on which the sensors shift therefore has two degrees of freedom in rotation, namely a rotational movement along a first axis 20 of the lens and a rotational movement along a diametrical axis 29 perpendicular to the above one. Each sensor 5, 5' is borne by a base plate 31 that shifts on the part 30, for example on the rail 10. To this end, the base plate has one or more pairs of rollers 32 that work together with the rail, which may be constituted by two structural T sections whose web plates face each other on one and the same axis. Rollers are thus fixed to the web plate of a first section and other roller get fixed to the base plate of the second section.

The base plate 31 is furthermore mechanically fixed to a piezoelectric motor. This motor shifts on the surface of the spherical lens by reptation. This movement of the piezoelectric motors by reptation or friction along the surface of the lens gives rise to rotational motions of the arc-shaped part 30 about the axes 20, 29. In fact, this part can be used only as a support for the sets of equipment formed for example by base plates, sensors and motors. Other support means may also be used.

Figure 4:
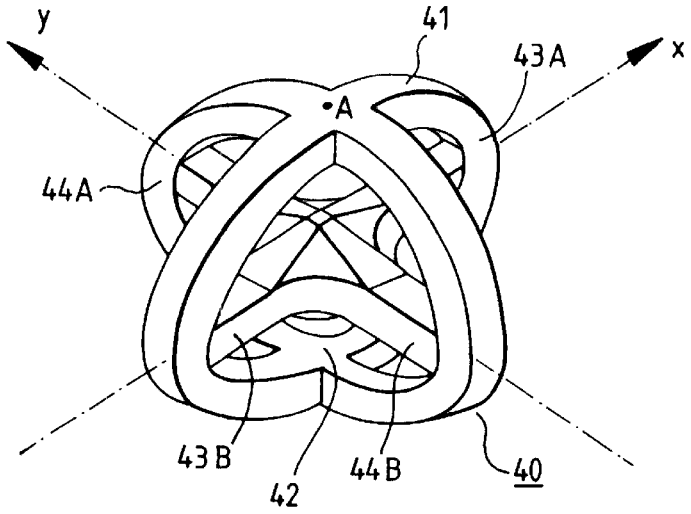
FIG. 4 exemplifies a piezoelectric motor that may be used in a device according to the invention.

FIG. 4 illustrates an exemplary piezoelectric motor 40 that can be used. This motor is described in the French patent application No. 96 08240. This motor can be shifted along two directions x, y. It has a shell 41 made of elastic material. On this shell 41, a point A comes into contact with the surface of the lens. This point A is opposite the base 42 of the motor which lies on the base plate 31. It is the movement of the point A on the spherical electromagnetic lens 1 that drives the motion of the associated sensor. The motor has two pairs of piezoelectric elements 43A, 43B and 44A, 44B. To activate the motor, a sinusoidal signal or other signal is sent at the resonance frequency of the piezoelectric elements. Under the effect of these signals, the piezoelectric elements are deformed, one in contraction and the other in elongation. A first pair of piezoelectric elements 43A, 43B may thus produce a movement along a first direction x and a second pair of piezoelectric elements 44A, 44B may thus produce a movement along the second direction y. The shifts of the piezoelectric elements are transmitted to the shell 20 which is thus subjected to independent deformations, producing the reptation of the point A along the surface of the spherical lens 1.

Figure 5:
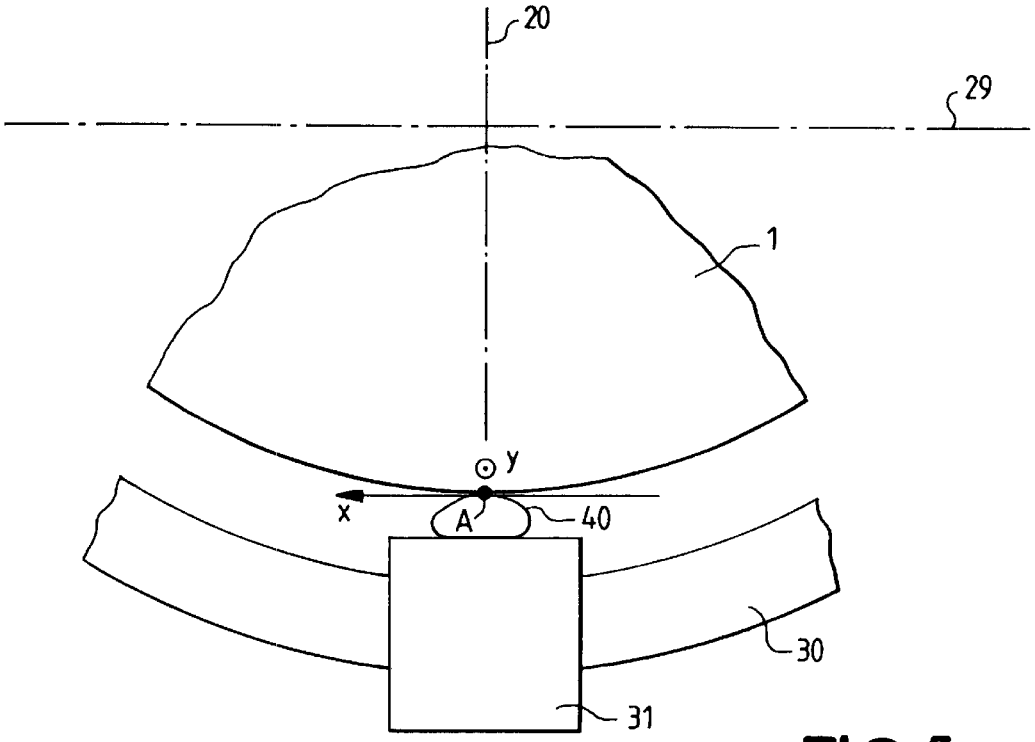
FIG. 5 illustrates the principle of operation of a device according to the invention.

FIG. 5 illustrates the operation of a motor drive system according to the invention. A set of sensor equipment is represented schematically by its base plate 31 and its piezoelectric motor 40 fixed to this base plate. Signals control the shifting of the piezoelectric motor along the surface of the spherical electromagnetic lens 1. More particularly, these control signals generate the movement of the point A by reptation on the surface of the lens. Since the piezoelectric motor is mechanically fixed to the base plate 31, its movement will cause the movement of the base plate. A movement of the point A along the axis y perpendicularly to the plane of the figure will cause the arc-shaped part 30 to rotate about a first diametrical axis 29 that is collinear for example with the half-shafts 27, 28. A movement of the point A along the axis x perpendicularly to the axis y will cause a movement of the base plate 31 with respect to the part 30, for example a movement on its rail 10, and/or a rotation of the part 30 about the diametrical axis 20 which is perpendicular to the previous axis 29. In fact, the free rotation of the arc-shaped part 30 about the first axis 29 and the second axis 20, as well as the free motion of the base plate 31 along the part 30 will enable the piezoelectric motor 40 to continue its reptation without undergoing any substantial mechanical stress from its support means, of which the part 30 and the base plate 31 especially are a part. In other words, since the support means hold the piezoelectric motor in the vicinity of the lens, it is the reptation of this motor on the surface that causes and therefore controls the motions of its support means. The support means are used by the motor to come into friction with the surface of the lens and therefore perform reptation motions, the motions of the support means being furthermore servo-linked to the motions of the motor.

Figure 6:
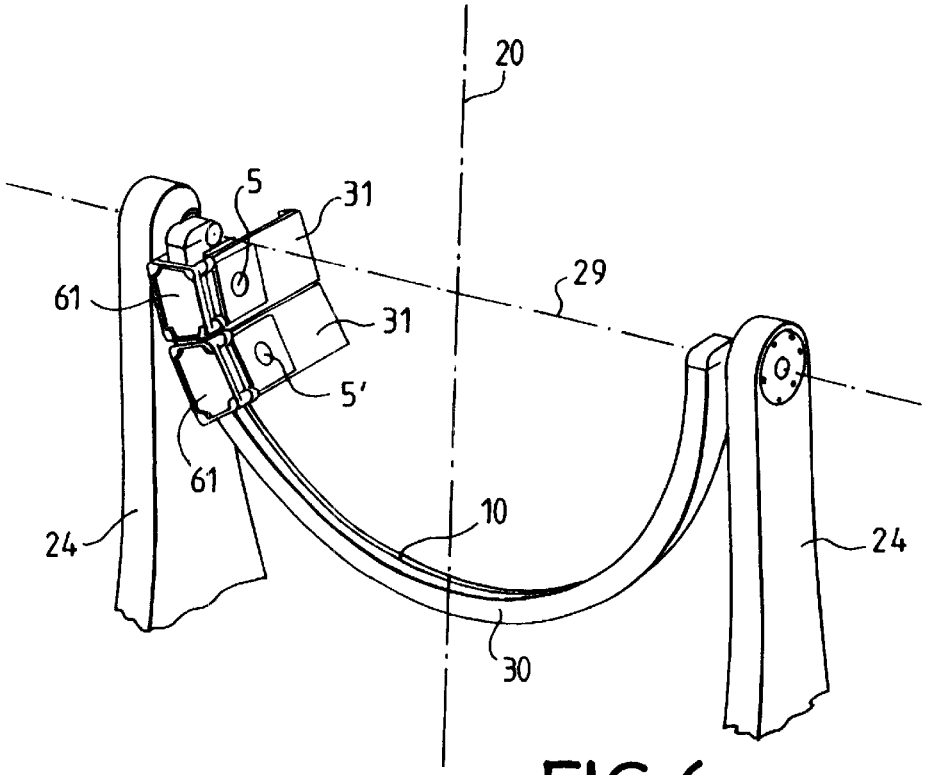
FIG. 6 shows a possible exemplary embodiment of a system for supporting a set of equipment comprising especially a microwave transmission and reception device and its associated piezoelectric motor.

FIG. 6 shows an exemplary possible embodiment of support means for the set of sensor equipment, other support means being of course possible. A set of sensor equipment comprises a base plate 31 supporting a sensor 5, 5' and a piezoelectric motor not shown in FIG. 6, as well as, for example, means for sliding on the arc-shaped part 30, for example a system of rollers 61 working together with a rail 10. In the example of FIG. 6, the part 30 pivots about an axis 29 while being mechanically linked, with one degree of freedom in rotation, to a part 24, for example a U-shaped part, in particular without using any half-shafts 27, 28. The part 24 which supports the arc-shaped part 30, itself has a rotational free motion about an axis 20 perpendicular to the previous axis of rotation 29. These two axes 20, 29 are diametrical axes, namely axes passing through the center of the spherical lens 1.

It is possible, in this embodiment as well as that of FIG. 3, to see to it that the part 24, which supports the arc-shaped part, will no longer also support the lens 1. This part 24 as well as, for example, the half-shafts 27, 28 then support only the sensors 5, 5' and especially their associated piezoelectric motors. In this case, other means of supporting the spherical lens must be used. It is possible for example to bond the lens to the upper part of the radome 22.

Figure 7:
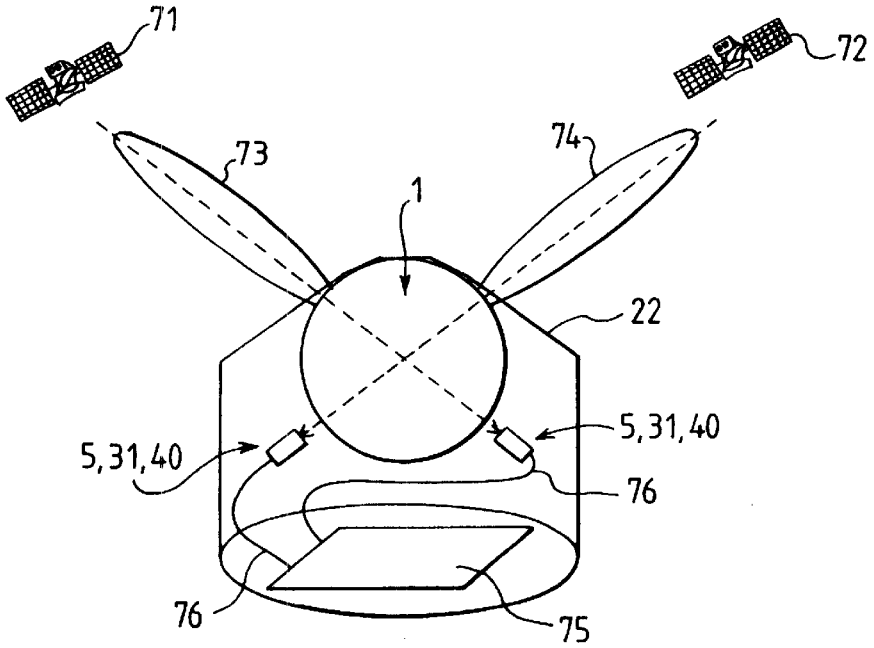
FIG. 7 shows an exemplary embodiment of a receiver and/or transmitter with spherical microwave lens according to the invention.

FIG. 7 illustrates a transmission and/or reception part with a spherical electromagnetic lens, for example of the Luneberg type, using a motor-drive device according to the invention, designed for a multiple-satellite communications application. In addition to the electromagnetic lens 1 and the radome 2, the transmission and/or reception device comprises at least two sensors 5 and their sets of equipment 31, 40 moving along the lower surface of the lens. A sensor comprises, in a known way, for example a transmission and/or reception horn associated with a microwave amplifier as well as supply means. The spherical electromagnetic lens 1 has, for example, a diameter of about 40 to 50 centimeters. For reasons of simplicity of representation, the support means of the equipment 5, 31, 40 have not been shown. In this embodiment, the spherical lens 1 is, for example, bonded to the upper part of the radome 22.

Each sensor generates a beam 73, 74 directly oriented to satellites 41, 42 providing optimal communication. The device can thus simultaneously track two satellites 71, 72 by means of these two sensors which are mobile throughout the surface of the lens. These satellites form part of a constellation of satellites. They are redundant, i.e. they are two satellites that give the same traffic of information. At least two satellites must be tracked in order to maintain a continuity of service, especially so that it is possible to switch over to another satellite when the orbiting is such that one of the satellites goes out of sight by vanishing over the horizon. In principle, the law governing the trajectory of satellites is known and it is possible to control the shifting of the sensors as a function of these laws. It is also possible to control the shifting of the sensors by servo-control as a function of the signals picked up from the satellites. The control of the shifting of a sensor 5 is actually the control of the shifting of its piezoelectric motor 40 by appropriate signals.

Each set of equipment 5, 31, 40 is thus connected to control means 75 by a link 76. This link for example gives an analog or digital signal designed to activate the piezoelectric motor of the set of equipment. Advantageously, this same link may convey the microwave signals and the low-frequency electrical signals proper to the sensor and to its set of equipment. In particular, a single cable 76 is used. An appropriate choice of the frequency bandplan is used to multiplex all the necessary signals, these signals being especially the microwave transmission and reception signals, the power supply signals, the reference microwave signals and the piezoelectric motor control signals.

To obtain shifting by friction or by the reptation of the piezoelectric motor along the surface of the spherical lens 1, this lens is for example covered, at least on its lower part, with a coating having a sufficient coefficient of friction. This coating is transparent to electromagnetic waves. Given that this transparency is not total, the lens is preferably covered beyond its lower half-surface by this coating to provide electrical continuity.

The control means 75 are for example of the printed circuit type. This circuit may furthermore comprise means of processing microwave signals received from the sensors, these processed signals being then given to user interface means.

A device according to the invention is very well suited to multimedia type, multiple-satellite communications applications, especially for home use. It is indeed both reliable and economical. The device is reliable because the motor-drive system for the sensors has few components which, furthermore, are mutually arranged in a simple way. The main components, especially the piezoelectric motors, are themselves highly reliable. Finally, there is an economy obtained, especially through the reduced number of components and the low complexity of operation.

The invention has other advantages. In particular, it reduces the weight of an entire transmission and/or reception device with Luneberg lens because, for example, it achieves a saving of four electrical motors and their associated components such as reduction gear by using two piezoelectric motors whose unit weight is far smaller than that of an electric motor. Another advantage given by the invention is that it improves the electric and microwave performance characteristics by simplifying mechanical structure.

What is claimed is:

1. A motor-drive device for transmission and/or reception modules in a receiver and/or transmitter with spherical electromagnetic lens, the device comprising, for each module, at least one piezoelectric motor rigidly connected to the module, the module moving along the surface of the lens by the reptation of the piezoelectric motor on the surface of the lens, wherein the module is capable of moving across the surface of the lens in at least a first direction and a second direction, the first direction being substantially perpendicular to the second direction.

2. A device according to claim 1, further comprising support means for supporting the piezoelectric motor along the surface of the lens, and wherein motion of the support means is controlled by motion of the piezoelectric motor.

3. A device according to claim 2, wherein the support means comprises at least one base plate, a part shaped like an arc of a circle in free rotation about the lens along a first axis, the base plate moving freely along the part shaped like an arc of a circle.

4. A device according to claim 3, wherein the part shaped like an arc of a circle comprises a second motion of free rotation about a second axis.

5. A device according to claim 4, wherein the second axis of rotation is perpendicular to the first axis of rotation.

6. A device according to claim 5, wherein the part shaped like an arc of a circle is supported by a free-rotation part with a free rotational motion with respect to the first axis, the free-rotation part having a motion of free rotation about the second axis of rotation.

7. A device according to any of the claims 3 to 6 wherein, with the part shaped like an arc of a circle comprising a rail, the base plate comprises one or more pairs of rollers that work together with the rail.

8. A device according to claim 3, wherein the base plate supports the module.

9. A receiver and/or transmitter with spherical electromagnetic lens, using a device according to claim 1.

10. A receiver and/or transmitter according to claim 8, wherein the lens is covered, at least on a half-surface, by a coating with a given coefficient of friction.

11. A receiver and/or transmitter according to any of the claims 8 or 9, wherein the lens is bonded to an upper part of a radome.

12. A receiver and/or transmitter according to claim 8, comprising means for controlling the piezoelectric motor and for processing microwave signals, said means for controlling and means for processing being connected by a single cable to an assembly constituted by a transmission and reception module and a piezoelectric motor, wherein a frequency bandplan enables multiplexing of the microwave signals.

13. A receiver and/or transmitter according to claim 12, wherein the cable conveys at least the microwave signals and control signals of the piezoelectric motors.

14. A receiver and/or transmitter according to claim 8, wherein the lens is a Luneberg lens.

15. A receiver and/or transmitter according to claim 8, comprising two transmission and reception modules.

16. A motor-drive device assembly for use with at least one of a receiver and a transmitter with spherical electromagnetic lens, said assembly comprising:

at least one of a transmission module and a reception module; and a piezoelectric motor connected to the module, wherein the module is adapted to move along a surface of the lens by reptation of the piezoelectric motor in at least a first direction and a second direction, said first direction being substantially perpendicular to said second direction.

17. The assembly according to claim 16, further comprising means for supporting the piezoelectric motor along the surface of the lens, wherein motion of the support means is controlled by the piezoelectric motor.

18. The assembly according to claim 17, wherein the support means comprises at least one base plate and an arc-shaped part adapted to be in free rotation about the lens along a first axis of rotation, and wherein the base plate is adapted to move freely along the arc-shaped part.

19. The assembly according to claim 18, wherein the arc-shaped part is freely rotatable about a second axis of rotation.

20. The assembly according to claim 19, wherein the second axis of rotation is perpendicular to the first axis of rotation.

21. The assembly according to claim 20, wherein the arc-shaped part is supported by a free-rotation part capable of free rotational motion with respect to the first axis, the free-rotation part having free rotation of motion about the second axis of rotation.

22. The assembly according to one of claims 18 to 21, wherein the arc-shaped part comprises a rail and wherein the base plate comprises one or more pairs of rollers adapted to cooperate with the rail.

23. The assembly according to claim 18, wherein the base plate is adapted to supports the module.

24. The assembly according to claim 23, wherein at least half of the surface of the lens is covered by a coating with a given coefficient of friction.

25. The assembly according to claim 23, wherein the lens is bonded to an upper part of a radome.

26. The assembly according to claim 23, further comprising:

means for controlling the piezoelectric motor; and means for processing microwave signals, wherein the means for controlling and means for processing are connected by a single cable to an assembly comprised of a transmission and reception module and a piezoelectric motor, and wherein a chosen bandplan enables multiplexing of signals.

27. The assembly according to claim 26, wherein the cable is adapted to convey at least the microwave signals and control signals of the piezoelectric motor.

28. The assembly according to claim 23, wherein the lens is a Luneberg lens.

29. The assembly according to claim 23, comprising two transmission and reception modules.

* * * * *